US011425957B2

(12) United States Patent
Bae

(10) Patent No.: US 11,425,957 B2
(45) Date of Patent: Aug. 30, 2022

(54) APPARATUS FOR RELIEVING TOE PAIN FOR SANDAL

(71) Applicant: Myung Su Bae, Gyeonggi-do (KR)

(72) Inventor: Myung Su Bae, Gyeonggi-do (KR)

( * ) Notice: Subject to any disclaimer, the term of this patent is extended or adjusted under 35 U.S.C. 154(b) by 69 days.

(21) Appl. No.: 17/040,750

(22) PCT Filed: Jan. 21, 2019

(86) PCT No.: PCT/KR2019/000805

§ 371 (c)(1),
(2) Date: Sep. 23, 2020

(87) PCT Pub. No.: WO2019/208907

PCT Pub. Date: Oct. 31, 2019

(65) Prior Publication Data

US 2021/0007436 A1 Jan. 14, 2021

(30) Foreign Application Priority Data

Apr. 25, 2018 (KR) ..... 10-2018-0047928

(51) Int. Cl.
*A43B 3/12* (2006.01)

(52) U.S. Cl.
CPC ..... *A43B 3/122* (2013.01); *A43B 3/12* (2013.01)

(58) Field of Classification Search
CPC ..... A43B 3/122; A43B 3/101; A43B 3/103; A43B 3/105
USPC ..... 36/94, 11.5
See application file for complete search history.

(56) References Cited

U.S. PATENT DOCUMENTS 7,980,005 B1 * 7/2011 Young ..... A43B 3/0047 36/11.5
8,806,781 B2 * 8/2014 Sabounjian ..... A43B 3/105 36/94
2002/0121030 A1 * 9/2002 Coleman ..... A43B 3/105 36/11.5

(Continued)

FOREIGN PATENT DOCUMENTS

JP 11-276203 A 10/1999
JP 2002-209609 A 7/2002

(Continued)

OTHER PUBLICATIONS

International Search Report for PCT/KR2019/000805 dated Apr. 18, 2019.

*Primary Examiner* — Marie D Bays
(74) *Attorney, Agent, or Firm* — The PL Law Group, PLLC

(57) ABSTRACT

An apparatus for relieving toe pain for sandals according to an embodiment of the present disclosure is formed on a top of a sole of a sandal, and includes a first unit formed on an upper surface of a sole of a sandal to surround an outer circumferential surface of a fixing rod arranged between a big toe and a second toe; a second unit formed on one side of the first unit in an up-down direction and forming a cutting open section for detachably coupling the first unit to the fixing rod; and a third unit formed on outer surfaces of the first unit and the second unit and reducing frictional resistance contacted between the big toe and the second toe. The apparatus may relieve or alleviate pain and fatigue in toes even when one wears them for a long time.

3 Claims, 5 Drawing Sheets

(56) References Cited

U.S. PATENT DOCUMENTS

| | | | | |
|---|---|---|---|---|
| 2006/0210751 | A1* | 9/2006 | Cunningham | A43B 3/0078<br>428/40.1 |
| 2006/0254092 | A1* | 11/2006 | Stevens | A43B 7/26<br>36/71 |
| 2008/0301977 | A1* | 12/2008 | Roberts | A43B 3/105<br>36/94 |
| 2009/0301497 | A1* | 12/2009 | Bruckmann | A61F 5/01<br>128/846 |
| 2010/0024247 | A1* | 2/2010 | Feeney | A43B 3/105<br>36/94 |
| 2011/0035962 | A1* | 2/2011 | Sabounjian | A43B 3/105<br>36/94 |
| 2013/0047464 | A1* | 2/2013 | Shuler | A43B 7/1425<br>36/62 |
| 2019/0289956 | A1* | 9/2019 | Eugene | A41B 11/003 |
| 2021/0007436 | A1* | 1/2021 | Bae | A43B 3/122 |

FOREIGN PATENT DOCUMENTS

| | | | |
|---|---|---|---|
| JP | 3106258 | U | 12/2004 |
| JP | 2016-140556 | A | 8/2016 |
| KR | 10-2013-0004409 | A | 1/2013 |
| KR | 10-1551484 | B1 | 9/2015 |

* cited by examiner

APPARATUS FOR RELIEVING TOE PAIN FOR SANDAL

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2019/000805, filed Jan. 21, 2019, which claims priority to the benefit of Korean Patent Application No. 10-2018-0047928 filed in the Korean Intellectual Property Office on Apr. 25, 2018, the entire contents of which are incorporated herein by reference.

TECHNICAL FIELD

The present invention relates to an apparatus for relieving toe pain for sandals, and more specifically to an apparatus for relieving toe pain for sandals that may relieve or alleviate pain and fatigue in toes even when one wears them for a long time.

DESCRIPTION OF THE RELATED ART

A sandal 5, also called flip-flops, is such that, as shown in FIG. 5, a sole of a user is in contact with a sole 1 on which a fixing rod 2 is formed between a big toe and a second toe, and fixing bands 3 and 3, which are respectively extended from an upper end of the fixing rod 2 to the left and right and fixed to both sides of the sole 1, cover the user's instep, and may be worn and walked.

As described above, in the sandal 5, the user's toe is fixed to the sole 1 by means of the fixing rod 2. Accordingly, the sandal 5 is worn to fit a foot, and it is possible to prevent slipping or separation between the sole of the foot and the sole 1 of the sandal 5.

As conceived from the point of view described above, there are such things as "sandals" (hereinafter, referred to as a prior art) of Patent No. 10-1551484.

The prior art relates to sandals in which a midsole may be fitted with a coupling ring for attaching and detaching uppers of leather, or an upper ring fixed to the uppers of leather may be fitted, and from a bottom of the midsole, a sole of a raw rubber protrudes from the midsole and is joined.

In general, sandals including the prior art have a thin fixing rod. Therefore, if they are in contact with a user's body, especially between a big toe and a second toe while wearing them for a long period of time to move, the friction between the toes causes a rubbing and burning sensation. In addition, there were many cases of complaining of pain or fatigue due to the pressure of the fixing rod.

In particular, general sandals including the prior art may be extremely disliked by the feeling that the fixing rod is sandwiched between the toes depending on the user wearing them. Therefore, there is an urgent need to develop tools and apparatuses that may improve the overall problems as described above.

SUMMARY

The present invention is invented to improve the problems described above, and is to provide an apparatus for relieving toe pain for sandals that may relieve or alleviate pain and fatigue in toes even when one wears them for a long time.

In order to achieve the objects described above, the present invention may provide an apparatus for relieving toe pain for sandals, including: a first unit formed on an upper surface of a sole of a sandal to surround an outer circumferential surface of a fixing rod arranged between a big toe and a second toe; a second unit formed on one side of the first unit in an up-down direction and forming a cutting open section for detachably coupling the first unit to the fixing rod; and a third unit formed on outer surfaces of the first unit and the second unit and reducing frictional resistance contacted between the big toe and the second toe.

Here, the first unit has a length corresponding to a distance from the sole to an upper end of the fixing rod, and includes a saddle-shaped contact support body having an arc-shaped cross section surrounding a portion of the outer circumferential surface of the fixing rod. In addition, the second unit is formed extending from both ends of the contact support body, and the third unit is formed on an inner surface and an outer surface of the contact support body.

Here, the second unit includes a first clamp piece extending from one end of the first unit surrounding a portion of the outer circumferential surface of the fixing rod to allow elastic deformation and elastic restoration, and a second clamp piece extending from the other end of the first unit to allow elastic deformation and elastic restoration, and to form the cutting open section together with the first clamp piece.

In addition, the third unit is viscose rayon, polynosic rayon, copper ammonium rayon, or rayon-based fiber layers forming a layered structure on the outer surfaces of the first unit and the second unit.

According to the present invention having the configuration described above, the following benefits may be achieved.

First, the present invention is formed on a top of a sole of a sandal, and includes a first unit formed on an upper surface of a sole of a sandal to surround an outer circumferential surface of a fixing rod arranged between a big toe and a second toe; a second unit formed on one side of the first unit in an up-down direction and forming a cutting open section for detachably coupling the first unit to the fixing rod; and a third unit formed on outer surfaces of the first unit and the second unit and reducing frictional resistance contacted between the big toe and the second toe. Therefore, one does not feel discomfort, pain, or fatigue even if one wears it for a long time. In addition, it is possible to relieve or alleviate pain and fatigue of a toe, thereby providing a user with a stable fit.

Furthermore, according to the present invention, the first unit has a length corresponding to a distance from the sole to an upper end of the fixing rod, and includes a saddle-shaped contact support body having an arc-shaped cross section surrounding a portion of the outer circumferential surface of the fixing rod. In addition, the second unit is formed extending from both ends of the contact support body, and the third unit is formed on an inner surface and an outer surface of the contact support body. Therefore, the fixing rod is prevented from directly contacting the user's body part, that is, a skin between the big toe and the second toe. As a result, it reduces frictional resistance and provides a smooth feel, and thus it may greatly help in relieving or alleviating pain and fatigue.

Additionally, according to the present invention, the second unit includes a first clamp piece extending from one end of the first unit surrounding a portion of the outer circumferential surface of the fixing rod to allow elastic deformation and elastic restoration, and a second clamp piece extending from the other end of the first unit to allow elastic deformation and elastic restoration, and to form the cutting open section together with the first clamp piece. Therefore, it provides the convenience of detachable coupling. In addition, it may provide convenience for maintenance, such as replacing with a new one, washing or cleaning.

Moreover, according to the present invention, the third unit is made of viscose rayon, polynosic rayon, copper ammonium rayon, rayon-based fiber layers forming a layered structure on the outer surfaces of the first unit and the second unit. Therefore, it may provide a smooth touch to the user when worn, and thus, it may reliably provide a stable fit.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION OF THE EMBODIMENTS

Figure 1:
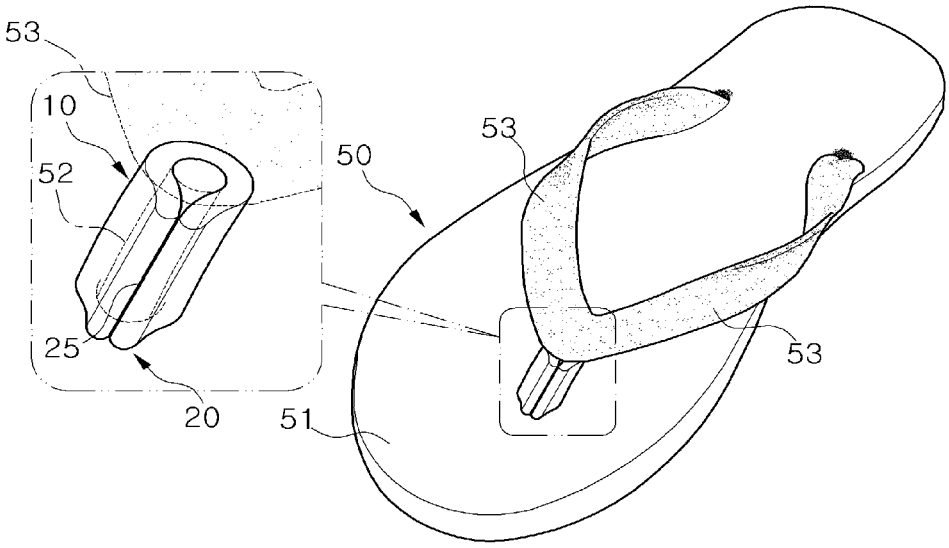
FIG. 1 is a perspective view showing a state in which an apparatus for relieving toe pain for sandals according to an embodiment of the present invention is mounted on a sandal.

The benefits and features of the present invention and methods to accomplish them will become apparent by reference to embodiments described in detail below with reference to the accompanying drawings.

However, the present invention is not limited to the embodiments described below, but may be embodied in various other forms.

The present embodiments are provided so that the disclosure of the present invention is thoroughly disclosed and that a person skilled in the art will fully understand the scope of the present invention.

Further, the present invention is defined only by the scope of the claims.

Therefore, in some embodiments, well known components, well known operations, and well-known techniques are not specifically described to avoid an undesirable interpretation of the present invention.

Also, like reference numerals refer to like elements throughout the specification. The terms (referred) used herein are intended to illustrate the embodiments and are not intended to limit the present invention.

Herein, singular forms include plural forms unless the context clearly dictates otherwise. The components and acts referred to as "comprise (or have)" do not exclude the presence or addition of one or more other components and acts.

Unless defined otherwise, all terms (including technical and scientific terms) used herein may be used in a sense commonly understood by a person skilled in the art to which the present invention belongs.

Further, the terms, which are generally used and are defined in a dictionary, are not ideally or excessively interpreted unless defined otherwise.

Hereinafter, preferred embodiments of the present invention will be described with reference to the accompanying drawings.

First, FIG. 1 is a perspective view showing a state in which an apparatus for relieving toe pain for sandals according to an embodiment of the present invention is mounted on a sandal 50.

Figure 2:
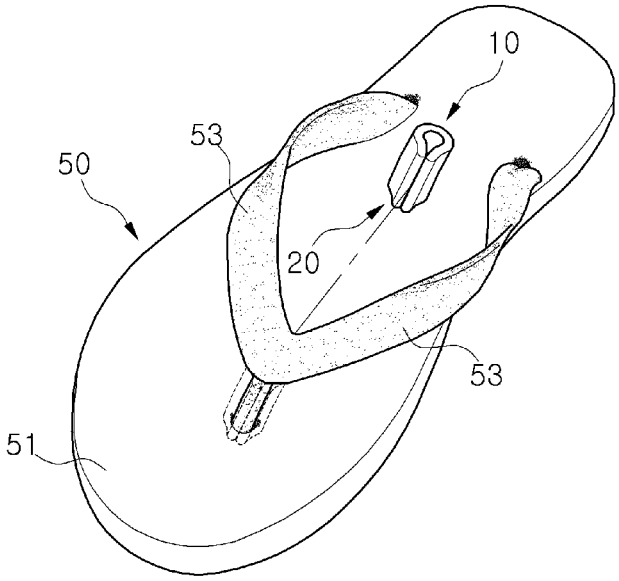
FIG. 2 is an exploded perspective view showing the state in which the apparatus for relieving toe pain for sandals according to the embodiment of the present invention is mounted on the sandal.

FIG. 2 is an exploded perspective view showing the state in which the apparatus for relieving toe pain for sandals according to the embodiment of the present invention is mounted on the sandal 50.

Figure 3:
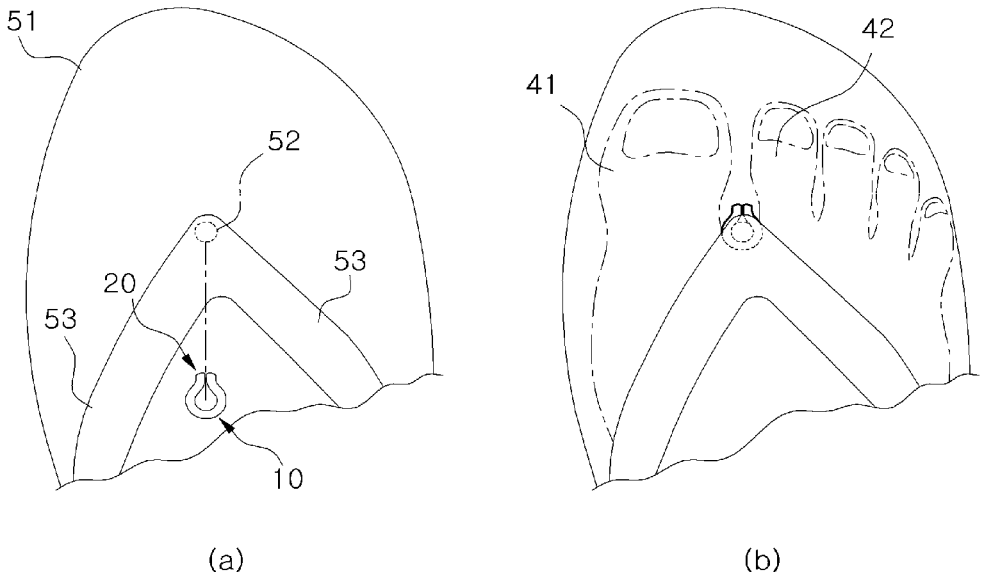
FIG. 3 is a partially exploded plan view sequentially and schematically illustrating a process in which the apparatus for relieving toe pain for sandals according to the embodiment of the present invention is mounted on the sandal.

FIG. 3 is a partially exploded plan view sequentially and schematically illustrating a process in which the apparatus for relieving toe pain for sandals according to the embodiment of the present invention is mounted on the sandal 50.

Figure 4:
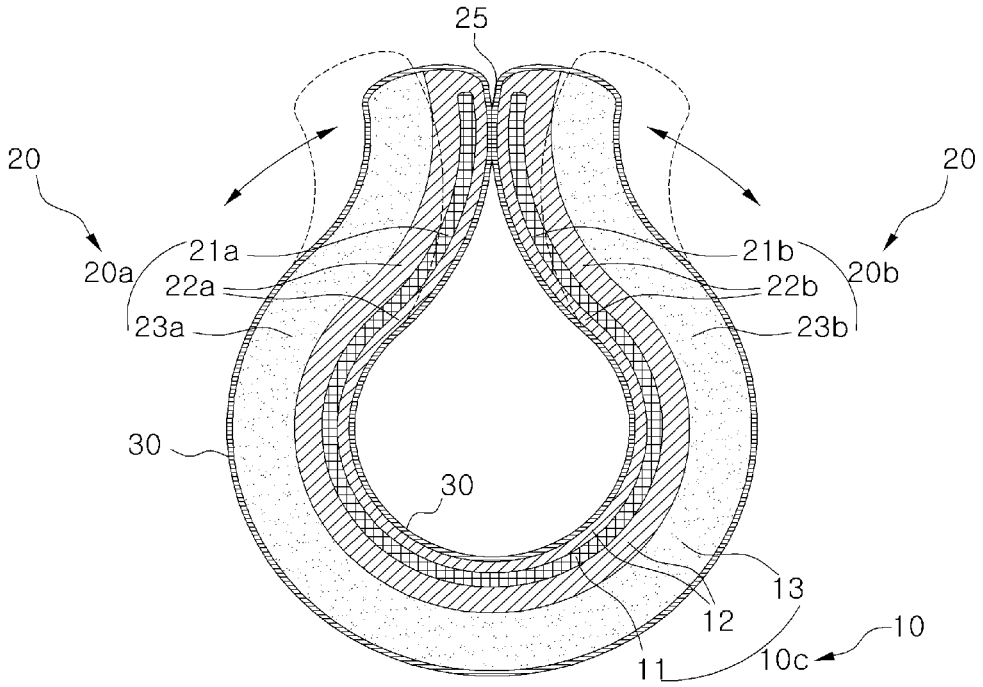
FIG. 4 is a plan cross-sectional conceptual view showing an internal structure of an apparatus for relieving toe pain according to another embodiment of the present invention.
Figure 5:
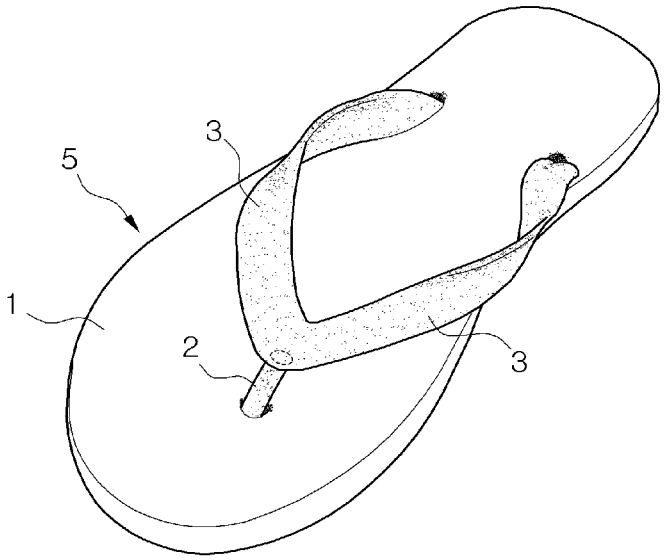
FIG. 5 is a perspective view showing a conventional sandal structure.

FIG. 4 is a plan cross-sectional conceptual view showing an internal structure of an apparatus for relieving toe pain according to another embodiment of the present invention.

According to the present invention, it may be seen that a second unit 20 is formed at both ends of a first unit 10, and a third unit 30 (see FIG. 4 below) is formed on the first unit 10 and the second unit 20.

First, the first unit 10 is formed on an upper surface of a sole 51 of the sandal 50 to surround an outer circumferential surface of a fixing rod 52 arranged between a big toe 41 (see (b) of FIG. 3) and a second toe 42 (see (b) of FIG. 3).

In other words, the first unit 10 is provided to prevent the outer circumferential surface of the fixing rod 52 from directly contacting a user's body, that is, a skin between the big toe 41 and the second toe 42.

Here, a structure of the sandal 50 includes the sole 51 on which the user's sole is in contact and the fixing rod 52 is formed, and fixing bands 53 and 53 connected to an upper end of the fixing rod 52 to cover and fix both sides of the user's instep and fixed to a left side and a right side of the sole 51.

The second unit 20 is formed in an up-down direction on one side of the first unit 10 and forms a cutting open section 25 for detachably coupling the first unit 10 to the fixing rod 52.

In other words, the second unit 20 provides convenience for a series of operations in which the first unit 10 is mounted on the fixing rod 52 or separated from the fixing rod 52 so as to prevent the first unit 10 from being in direct contact with the user's body.

The third unit 30 is formed on outer surfaces of the first unit 10 and the second unit 20 and reduces frictional resistance contacted between the big toe 41 and the second toe 42.

In other words, the third unit 30 may eliminate or alleviate any discomfort, pain, or fatigue felt by the user because the outer circumferential surface of the fixing rod 52 directly contacts the user's body, thereby giving a smooth touch and providing a stable fit.

Naturally, the embodiment as described above may be applied to the present invention, and the following various embodiments may also be applied to the present invention.

First, referring to FIG. 4, more specifically, in an embodiment, the first unit may has a length corresponding to a distance from the sole 51 to an upper end of the fixing rod 52, and include a saddle-shaped contact support body 10*c* having an arc-shaped cross section surrounding a portion of the outer circumferential surface of the fixing rod 52.

Here, it may be seen that the second unit 20, which will be described later, is formed extending from both ends of the contact support body 10*c*, and the third unit 30, which will be described later, is formed on an inner surface and an outer surface of the contact support body 10*c*.

Here, the first unit 10 may include an inner frame piece 11 which constitutes the contact support body 10*c*, in which the inner frame piece 11 has an arc-shaped cross section and is formed into a saddle shape to allow elastic deformation.

The first unit 10 may include an outer frame piece 12, in which the outer frame piece 12 surrounds an inner surface and an outer surface of the inner frame piece 11 and is made of a material having a lower hardness than the inner frame piece 11.

In addition, the first unit 10 may include a buffer pad 13, in which the buffer pad 13 is formed in a certain thickness on an outer surface of the outer frame piece 12, and is made of a material having a lower hardness than the outer frame piece 12 to absorb or disperse pressure and impact applied from the outside.

Here, it may be seen that the second unit 20, which will be described later, is formed of the same material extending from both ends of the inner frame piece 11, both ends of the outer frame piece 12, and both ends of the buffer pad 13, and the third unit 30, which will be described later, is formed on an inner surface of the outer frame piece 12 and an outer surface of the buffer pad 13.

In an embodiment, as shown in FIG. 4, the second unit may include a first clamp piece 20*a* extending from one end of the first unit 10 surrounding a portion of the outer circumferential surface of the fixing rod 52 to allow elastic deformation and elastic restoration, and a second clamp piece 20*b* extending from the other end of the first unit 10 to allow elastic deformation and elastic restoration, and to form the cutting open section 25 together with the first clamp piece 20*a*.

Here, the first clamp piece 20*a* may include a first internally extending frame piece 21*a*, in which the first internally extending frame piece 21*a* has an arc-shaped cross section that extends from one end of the inner frame piece 11 of the first unit 10 and is convex toward the second clamp piece 20*b*, and is formed in a saddle shape to allow elastic deformation.

Here, the first clamp piece 20*a* may include a first externally extending frame piece 22*a*, in which the first externally extending frame piece 22 surrounds an inner surface and an outer surface of the first internally extending frame piece 21*a*, and is made of a material having a lower hardness than the first internally extending frame piece 21*a*.

In addition, the first clamp piece 20*a* may include a first extended buffer pad 23*a*, in which the first extended buffer pad 23*a* is formed in a certain thickness on an outer surface of the first externally extending frame piece 22*a*, and is made of a material having a lower hardness than the first externally extending frame piece 22*a* to absorb or disperse pressure and impact applied from the outside.

Therefore, it may also be seen that the third unit 30, which will be described later, is formed on an inner surface of the first externally extending frame piece 22*a* and an outer surface of the first extended buffer pad 23*a*.

The second clamp piece 20*b* may include a second internally extending frame piece 21*b*, in which the second internally extending frame piece 21*b* has an arc-shaped cross section that extends from the other end of the inner frame piece 11 of the first unit 10 and is convex toward the first clamp piece 20*a*, and is formed in a saddle shape to allow elastic deformation.

Here, the second clamp piece 20*b* may include a second externally extending frame piece 22*b*, in which the second externally extending frame piece 22 surrounds an inner surface and an outer surface of the second internally extending frame piece 21*b*, and is made of a material having a lower hardness than the second internally extending frame piece 21*b*.

Here, the second clamp piece 20*b* may include a second extended buffer pad 23*b*, in which the second extended buffer pad 23*b* is formed in a certain thickness on an outer surface of the second externally extending frame piece 22*b*, and is made of a material having a lower hardness than the second externally extending frame piece 22*b* to absorb or disperse pressure and impact applied from the outside.

Therefore, it may also be seen that the third unit 30, which will be described later, is formed on an inner surface of the second externally extending frame piece 22*b* and an outer surface of the second extended buffer pad 23*b*.

The third unit 30 includes viscose rayon, polynosic rayon, copper ammonium rayon, rayon-based fiber layers forming a layered structure on the outer surfaces of the first unit 10 and the second unit 20. In addition to the fibers described above, any fiber material that provides a smooth texture by reducing frictional resistance and has excellent durability, abrasion resistance, impact resistance, and chemical resistance may be used.

In order to mount the apparatus for relieving toe pain for sandals according to the embodiment of the present invention to the sandal 50 as shown in FIG. 1, the user aims so that the cutting open section 25 of the second unit 20 faces the fixing rod 52 as shown in FIG. 2 and (a) of FIG. 3.

Then, the user presses the cutting open section 25 to the fixing rod 52 to open it, and then pushes it continuously. As a result, as shown in FIG. 1, installation of the apparatus for relieving toe pain for sandals according to the embodiment of the present invention is completed on the fixing rod 52. Therefore, the user may wear it and move as shown in (b) of FIG. 3.

Hereinafter, the action and effect of an apparatus for relieving toe pain for sandals according to a preferred embodiment of the present invention will be described as follows.

First, the present invention is formed on a top of a sole of a sandal, and includes a first unit 10 formed on an upper surface of a sole 51 of a sandal 50 to surround an outer circumferential surface of a fixing rod 52 arranged between a big toe 41 and a second toe 42; a second unit 20 formed on one side of the first unit 10 in an up-down direction and forming a cutting open section 25 for detachably coupling the first unit 10 to the fixing rod 52; and a third unit 30 formed on outer surfaces of the first unit 10 and the second unit 20 and reducing frictional resistance contacted between the big toe 41 and the second toe 42. Therefore, one does not feel discomfort, pain, or fatigue even if one wears it for a long time. In addition, it is possible to relieve or alleviate pain and fatigue of a toe, thereby providing a user with a stable fit.

Furthermore, according to the present invention, the first unit 10 has a length corresponding to a distance from the sole 51 to an upper end of the fixing rod 52, and includes a saddle-shaped contact support body 10*c* having an arc-shaped cross section surrounding a portion of the outer circumferential surface of the fixing rod 52. In addition, the second unit 20 is formed extending from both ends of the contact support body 10*c*, and the third unit 30 is formed on an inner surface and an outer surface of the contact support body 10*c*. Therefore, the fixing rod 52 is prevented from directly contacting the user's body part, that is, a skin between the big toe 41 and the second toe 42. As a result, it reduces frictional resistance and provides a smooth feel, and thus it may greatly help in relieving or alleviating pain and fatigue.

Additionally, according to the present invention, the second unit 20 includes a first clamp piece 20*a* extending from one end of the first unit 10 surrounding a portion of the outer circumferential surface of the fixing rod 52 to allow elastic deformation and elastic restoration, and a second clamp piece 20*b* extending from the other end of the first unit 10 to allow elastic deformation and elastic restoration, and to form the cutting open section 25 together with the first clamp piece 20*a*. Therefore, it provides the convenience of detachable coupling. In addition, it may provide convenience for maintenance, such as replacing with a new one, washing or cleaning.

Moreover, according to the present invention, the third unit 30 is made of viscose rayon, polynosic rayon, copper ammonium rayon, rayon-based fiber layers forming a layered structure on the outer surfaces of the first unit 10 and the second unit 20. Therefore, it may provide a smooth touch to the user when worn, and thus, it may reliably provide a stable fit.

As described above, it may be seen that the basic technical teaching of the present invention is to provide an apparatus for relieving toe pain for sandals that may relieve or alleviate pain and fatigue in toes even when one wears them for a long time.

In addition, numerous other variations and applications are of course possible for those skilled in the art within the scope of the basic technical teaching of the present invention.

What is claimed is:

1. An apparatus for relieving toe pain for sandals comprising a sole, a fixing rod attached to the sole, and fixing bands extended from an upper end of the fixing rod to the sole for covering a user's instep, the apparatus comprising:

an inner frame piece;

an outer frame piece in which the inner frame piece is embedded, the outer frame piece made of a material having a lower hardness than the inner frame piece; and a fiber material layer surrounding the outer frame piece, wherein the apparatus has a portion having an arc shape and a pair of extended portions extending from both ends of the arc shape and allowing elastic deformation so that the pair of extended portion has a closed state when the pair of extended portions contact each other and an open state when the pair of extended portions are forced to be spaced apparat from each other by the elastic deformation.

2. The apparatus of claim 1, wherein the fiber material layer comprises a material selected from the group consisting of viscose rayon, polynosic rayon, copper ammonium rayon, rayon-based fiber, and a combination thereof.

3. The apparatus of claim 1, further comprising a buffer pad between the outer frame piece and the fiber material layer, and the buffer pad is made of a material having a lower hardness than the outer frame piece.

* * * * *